US010378750B2

(12) United States Patent
Rebiffe et al.

(10) Patent No.: US 10,378,750 B2
(45) Date of Patent: Aug. 13, 2019

(54) LIGHTING MODULE WITH DIODES HAVING IMPROVED COOLING

(71) Applicant: XYZED, Paris (FR)

(72) Inventors: Maurice Rebiffe, Paris (FR); Laurent Mivis, Les Pavillons Sous Bois (FR)

(73) Assignee: XYZED, Paris (FR)

( * ) Notice: Subject to any disclaimer, the term of this patent is extended or adjusted under 35 U.S.C. 154(b) by 203 days.

(21) Appl. No.: 15/542,996

(22) PCT Filed: Jan. 11, 2016

(86) PCT No.: PCT/FR2016/050041
§ 371 (c)(1),
(2) Date: Jul. 12, 2017

(87) PCT Pub. No.: WO2016/113491
PCT Pub. Date: Jul. 21, 2016

(65) Prior Publication Data

US 2018/0003372 A1 Jan. 4, 2018

(30) Foreign Application Priority Data

Jan. 12, 2015 (FR) ..... 15 50210

(51) Int. Cl.
*F28F 3/12* (2006.01)
*F21V 15/01* (2006.01)
(Continued)

(52) U.S. Cl.
CPC ..... *F21V 29/58* (2015.01); *F21V 29/59* (2015.01); *F28F 3/12* (2013.01); *F28F 13/003* (2013.01);
(Continued)

(58) Field of Classification Search
CPC ..... F21V 15/01; F21V 29/58; F21V 29/59; F21Y 2115/10; F21Y 2105/10; F28F 13/003; F28F 3/12
See application file for complete search history.

(56) References Cited

U.S. PATENT DOCUMENTS

2008/0105413 A1 5/2008 Peng
2009/0321045 A1 12/2009 Hernon et al.
(Continued)

FOREIGN PATENT DOCUMENTS

EP 2085681 A2 * 8/2009 ..... F21V 29/004

OTHER PUBLICATIONS

French Search Report for corresponding French Application No. FR1550210, dated Jun. 19, 2015.
(Continued)

*Primary Examiner* — Robert J May
*Assistant Examiner* — Leah Simon Macchiarolo
(74) *Attorney, Agent, or Firm* — Workman Nydegger

(57) ABSTRACT

A diode lighting module comprising both a diode matrix mounted on a support plate and heat dissipator means for dissipating the heat given off by the diode matrix, includes a metal plate having an outside face in contact with the support plate and an inside face supporting a cellular metal foam including a plurality of calibrated holes passing through each cell in two perpendicular directions, and a vessel-forming box filled with the cellular metal foam and for which the metal plate constitutes a lid. The box has inlet and outlet orifices passing through the box to receive a cooling liquid, and a separator defining two separate cooling fluid flow zones in the cellular metal foam, a cooling fluid feed zone and a cooling fluid discharge zone, with passage from one of the zones to the other taking place through a cutout in the separator.

10 Claims, 1 Drawing Sheet

(51) Int. Cl.

| | |
|---|---|
| ***F21V 29/58*** | (2015.01) |
| ***F28F 13/00*** | (2006.01) |
| ***F21Y 105/10*** | (2016.01) |
| ***F21Y 115/10*** | (2016.01) |
| ***F21W 131/205*** | (2006.01) |

(52) U.S. Cl.
CPC ..... *F21V 15/01* (2013.01); *F21W 2131/205* (2013.01); *F21Y 2105/10* (2016.08); *F21Y 2115/10* (2016.08)

(56) References Cited

U.S. PATENT DOCUMENTS

| | | | | |
|---|---|---|---|---|
| 2010/0134017 | A1 | 6/2010 | Yatsuda et al. | |
| 2010/0265709 | A1* | 10/2010 | Liu | F21K 9/00 362/249.02 |
| 2011/0006657 | A1* | 1/2011 | Liu | F21V 29/004 313/12 |
| 2015/0200344 | A1* | 7/2015 | Francis | F21V 29/00 257/99 |

OTHER PUBLICATIONS

International Search Report for corresponding International PCT Application No. PCT/FR2016/050041, dated Mar. 24, 2016.

* cited by examiner

LIGHTING MODULE WITH DIODES HAVING IMPROVED COOLING

FIELD OF THE INVENTION

The present invention relates to the field of light-emitting diode (LED) or laser diode projectors for stage or spectacle lighting, and it relates more particularly to a diode lighting module presenting optimized heat dissipation.

PRIOR ART

Present light-emitting diode or laser diode technology requires the temperature of such diodes to be maintained at a constant value. For this purpose, it is essential to be able to dump all excess heat, preferably in uniform manner, while also regulating temperature.

A first method that is commonly used for dumping heat is to have recourse to a finned aluminum radiator that is placed on the surface for cooling. A fan is also often added to accelerate the dissipation of heat.

A second known method consists in using the technique of heat pipes in which heat is taken away from the hot point by pipes filled with cooling fluid and coupled to ventilated fins.

Nevertheless, those two methods are poorly adapted to present diode lighting technologies since they require cooling that is more considerable and also more accurate in order to ensure optimum efficiency for the diodes. Cooling by fluid (generally by water) has thus become essential and it is nowadays common practice to use cold block systems with a compressor. In such systems, plates, which are often aluminum plates, are used to sandwich the circuits or pipes conveying the fluids cooled by the cold block in order to capture a maximum amount of heat. This results in a system that is heavy, complex, and expensive, suffering from considerable drawbacks. Specifically, the stack of different materials creates numerous heat bridges and the fluid flow pipes require a large amount of space, while limiting heat dissipation.

OBJECT AND DEFINITION OF THE INVENTION

The present invention proposes overcoming these limitations with a heat dissipation device for a diode matrix that makes it possible, effectively and at low cost to obtain a temperature that is constant in a manner that is simple and reliable. An object of the invention is also to control temperature without significantly modifying the matrix.

These objects are achieved by a diode lighting module comprising both a diode matrix mounted on a support plate and heat dissipator means for dissipating the heat given off by said diode matrix, the module being characterized in that said heat dissipator means comprise:

a metal plate having an outside face in contact with said support plate and an inside face supporting a cellular metal foam, said cellular metal foam including a plurality of calibrated holes passing through each cell in two perpendicular directions; and a vessel-forming box filled with said cellular metal foam and for which said metal plate constitutes a lid, said box including:

an inlet orifice passing through said box to receive a cooling fluid;

an outlet orifice for discharging said cooling fluid; and a separator defining two separate flow zones for said cooling fluid in said cellular metal foam, one zone for feeding said cooling fluid from said inlet orifice and one zone for discharging said cooling fluid towards said outlet orifice, the passage from one zone to the other taking place via a cutout in said separator.

With this cellular foam passing the fluid over its entire surface area, the cold fluid coming from the cold block enters into an emulsion by a vortex effect, thereby picking up the heat that is given off as well as possible.

Preferably, said diodes are light-emitting diodes or laser diodes, and said separator forms an integral portion of said box.

In an embodiment, said cellular metal foam has two superposed levels of cells, each having calibrated holes pierced along said two perpendicular directions, additional holes also being provided at least in the top of each cell for communication between these two superposed levels and, preferably, said two perpendicular directions are inclined respectively at about 45° and at about 135° relative to an injector or return direction for the cooling fluid.

Advantageously, said box includes at least one groove, and preferably two concentric grooves, for receiving one or two annular gaskets providing sealing with said metal plate, said support plate being fastened to said box by a plurality of screws arranged regularly outside said at least one groove.

Preferably, said support plate includes a blind orifice suitable for receiving a temperature sensor, and said cooling fluid is water in the liquid phase or a mixture of water plus glycol.

BRIEF DESCRIPTION OF THE DRAWING

The characteristics and advantages of the present invention appear better from the following description made by way of non-limiting indication, and given with reference to the accompanying drawing, in which.

DETAILED DESCRIPTION OF A PREFERRED EMBODIMENT

Figure 1:
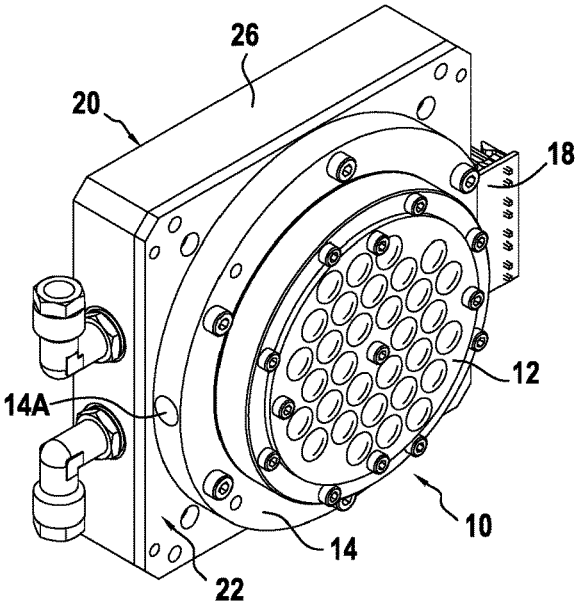
FIG. 1 is a perspective view of a lighting module of the invention.

As known and shown in FIG. 1, a lighting module 10 using diodes of the light-emitting type or of the laser type for stage or spectacle projectors comprises a matrix 12 of diodes having the same predetermined wavelength, and preferably in a regular distribution, facing an optical system (not shown) for collimating the light beam and made up of lenses made of plastics material or glass that are of very small size and carried by centering elements. The matrix of diodes having a determined number of diodes of power that varies depending on the type and the technology used, is mounted on a support plate 14 having conductor tracks 16 (shown in FIG. 4) that are connected to electricity power supply terminals 18 and in contact with which there are arranged heat dissipator means 20 for dissipating the heat given off by the matrix of diodes.

Figure 2:
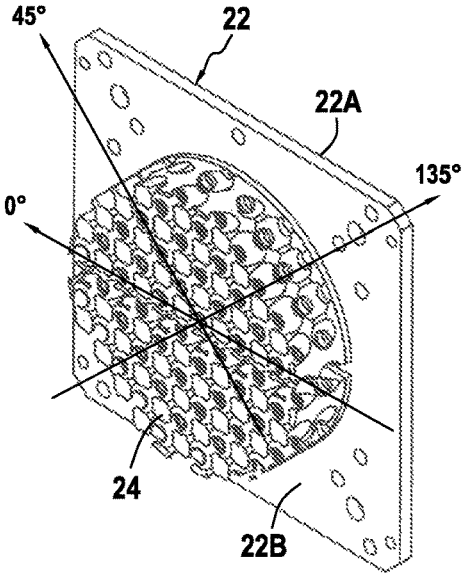
FIG. 2 shows an example of cellular metal foam used in the FIG. 1 lighting module.

In the invention, and as shown in FIG. 2, these heat dissipator means comprise a metal junction plate 22 having an outside face 22A that is contact with the support plate and an inside face 22B that supports a cellular metal foam 24 contained in a box 26 in the form of a partitioned vessel, that is leaktight to a cooling fluid and for which the metal junction plate 22 constitutes the lid.

Figure 3:
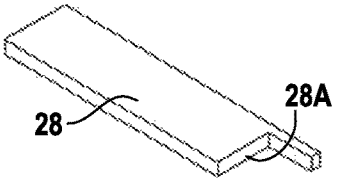
FIG. 3 shows an example of a separator used in the FIG. 1 lighting module.
Figure 5:
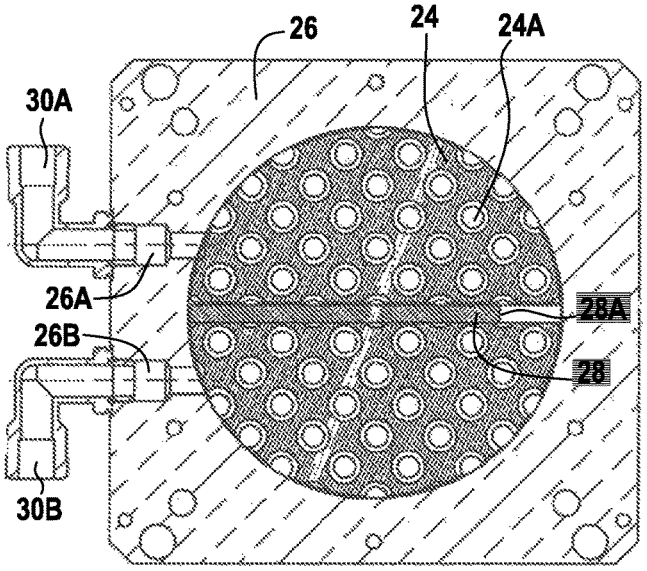
FIG. 5 is a section view on the horizontal midplane of FIG. 1.

The partitioning of the vessel that separates the cellular foam into two independent identical portions is provided by a separator 28 (see FIG. 3) that is advantageously fastened in the metal junction plate 22 (nevertheless a separator forming an integral portion of the vessel could also be envisaged) and including a cutout 28A for passing the cooling fluid, so as to define a flow direction for the fluid with a feed zone from an inlet orifice 26A and a discharge zone towards an outlet orifice 26B, these inlet and outlet orifices, preferably having the same diameter, passing through the box 26 and being designed to receive couplings 30A, 30B (see FIG. 5) necessary respectively for injecting and discharging the cooling liquid from and to a liquid tank (not shown) via appropriate delivery pipes (also not shown).

Figure 4:
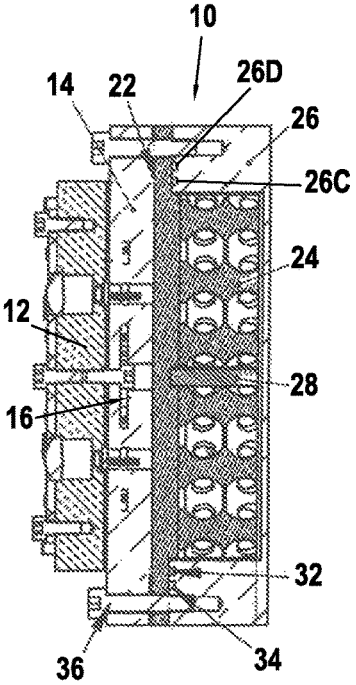
FIG. 4 is a section view on a vertical midplane of FIG. 1.

The partitioned vessel 26 and the metal junction plate 22 shown in FIG. 4 are sealed by at least one annular gasket 32 arranged in a groove 26C of the box 26. Nevertheless, and preferably, this sealing is provided by two annular gaskets 32 and 34 that are arranged in two concentric grooves 26C and 26D. The assembly comprising the vessel and the plate is fastened together by a plurality of screws 36 arranged regularly outside the grooves.

In order to guarantee that the fluid pressure in the box never exceeds its operating pressure by more than 50 kilopascals (kPa) (0.5 bar) because that is the pressure below which specific safety devices are not required by regulation, given the absence of any significant risk of leakage (i.e. for an operating pressure of 3 bar, a fluid pressure of 3.5 bar is selected), the cellular metal foam 24 has a plurality of calibrated holes passing through each cell in two perpendicular directions so as to form four holes in each cell in the metal foam. Advantageously, each cell is substantially spherical in shape. Preferably, and as shown in FIG. 2, these two perpendicular directions are inclined respectively at about 30° to 60° (typically 45°) and at about 120° to 150° (typically 135°) relative to the injection or return direction for the cooling fluid, which defines the reference at 0°.

In the example shown, the cellular metal foam 24 has two superposed levels of cells, and each of them is provided with at least one additional hole 24A at its top for fluid communication between the two levels of cells. More particularly, each cell has two facing holes passing therethrough, one at its top and the other at its base, the holes at the top in the top level of cells providing direct contact for the cooling fluid with the plate 22, and the holes in the base in the bottom level of cells providing contact with the bottom of the vessel 26.

In order to guarantee lighting with brightness that is always identical, in particular after long durations of operation, it is necessary to maintain the diode matrix 12 at a constant temperature around 20° C. to 30° C. (i.e. plus or minus 5° C. relative to a reference temperature that is typically 25° C.), and to control this temperature. Thus, the support plate 14 includes in its periphery a blind orifice 14A for receiving a temperature sensor that is to be connected to a control unit for injecting cooling fluid into the box 26. The injection of cooling fluid, advantageously water in the liquid phase or in a water-glycol mixture, takes place at a flow rate that is constant and at a temperature that preferably lies in the range 15° C. to 25° C., and in order to maintain the diode matrix at the above-mentioned desired temperature, the return of this cooling fluid after passing through the cellular metal foam 24 and exchanging heat with the support plate of the diode matrix then takes place at a temperature lying in the range 35° C. to 45° C.

Advantageously, the inclination of the directions in which calibrated holes are formed in the cellular foam relative to the injection of the cooling fluid leads to shocks being created against the cells, thereby imparting a vortex effect to the fluid and thus maximizing exchanges of heat. By entering into an "emulsion", the cooling fluid is better at picking up the heat that is given off, with this taking place over the entire surface area of the diode matrix.

The invention thus proposes a diode lighting module that is simple to make, particularly effective from a thermal point of view because of the proximity of the cooling fluid to the diode matrix, and that enables the dissipation of the heat given by the diode matrix to be optimized in a manner that is regular and uniform.

The invention claimed is:

1. A diode lighting module comprising both a diode matrix mounted on a support plate and heat dissipator means for dissipating the heat given off by said diode matrix, wherein said heat dissipator means comprise:

a metal plate having an outside face in contact with said support plate and an inside face supporting a cellular metal foam, said cellular metal foam including a plurality of calibrated holes passing through each cell in two perpendicular directions; and a vessel-forming box filled with said cellular metal foam and for which said metal plate constitutes a lid, said box including:

an inlet orifice passing through said box to receive a cooling fluid;

an outlet orifice for discharging said cooling fluid; and a separator defining two separate flow zones for said cooling fluid in said cellular metal foam, one zone for feeding said cooling fluid from said inlet orifice and one zone for discharging said cooling fluid towards said outlet orifice, the passage from one zone to the other taking place via a cutout in said separator.

2. The lighting module according to claim 1, wherein said diodes are light-emitting diodes or laser diodes.

3. The lighting module according to claim 1, wherein said cellular metal foam has two superposed levels of cells, each having calibrated holes pierced along said two perpendicular directions, additional holes also being provided at least in the top of each cell for communication between these two superposed levels.

4. The lighting module according to claim 3, wherein said two perpendicular directions are inclined respectively at about 45° and at about 135° relative to an injector or return direction for the cooling fluid.

5. The lighting module according to claim 1, wherein said separator forms an integral portion of said box.

6. The lighting module according to claim 1, wherein said box includes at least one groove for receiving an annular gasket for providing sealing with said metal plate.

7. The lighting module according to claim 6, wherein said box includes two concentric grooves, each receiving an annular gasket for providing sealing with said metal plate.

8. The lighting module according to claim 6, wherein said support plate is fastened to said box by a plurality of screws arranged regularly outside said at least one groove.

9. The lighting module according to claim 1, wherein said support plate includes a blind orifice suitable for receiving a temperature sensor.

10. The lighting module according to claim 1, wherein said cooling fluid is water in the liquid phase or a mixture of water plus glycol.

* * * * *